US005467194A

United States Patent [19]

Pellinen et al.

[11] Patent Number: 5,467,194

[45] Date of Patent: Nov. 14, 1995

[54] METHOD AND DEVICE FOR PHOTOELECTRIC IDENTIFICATION OF A MATERIAL WEB

[75] Inventors: Kari Pellinen, Säynätsalo; Jukka Koiranen, Jyväskylä ; Kari Erkkilä, Palokka; Juhani Ahola, Jyväskylä ; Harri Vähätalo, Jyväskylä, all of Finland

[73] Assignee: Valmet Paper Machinery, Inc., Helsinki, Finland

[21] Appl. No.: 135,315

[22] Filed: Oct. 12, 1993

Related U.S. Application Data

[63] Continuation of Ser. No. 719,762, Jun. 24, 1991, abandoned.

[30] Foreign Application Priority Data

Feb. 6, 1991 [FI] Finland ..... 910571

[51] Int. Cl.[6] ..... G01N 21/47

[52] U.S. Cl. ..... 356/429; 250/559.29

[58] Field of Search ..... 356/429, 430; 250/561, 548, 561

[56] References Cited

U.S. PATENT DOCUMENTS

| | | | |
|---|---|---|---|
| 3,496,365 | 2/1970 | Mounce . | |
| 3,739,177 | 6/1973 | Ko | 250/561 |
| 3,746,451 | 7/1973 | Croissand et al. | 356/430 |
| 3,931,513 | 1/1976 | Germain | 250/561 |
| 3,966,494 | 12/1976 | Suga . | |
| 4,019,066 | 4/1977 | Lucas et al. | 356/429 |
| 4,095,887 | 6/1978 | van Herten et al. | 250/548 |
| 4,146,797 | 3/1979 | Nakagawa | 250/548 |
| 4,186,309 | 1/1980 | Gnuechtel | 250/561 |
| 4,501,953 | 2/1985 | Hollinetz | 356/430 |
| 4,644,174 | 2/1987 | Ouellette et al. | 356/430 |
| 4,781,195 | 11/1988 | Martin | 356/41 |
| 4,851,689 | 7/1989 | Hasegawa | 250/214 B |

FOREIGN PATENT DOCUMENTS

| | | |
|---|---|---|
| 0106672A1 | 4/1984 | European Pat. Off. . |
| 0379281 | 7/1990 | European Pat. Off. . |
| 2746808 | 5/1978 | Germany . |
| 3037622 | 4/1982 | Germany . |
| 1479603 | 7/1977 | United Kingdom . |
| 2087544 | 5/1982 | United Kingdom . |
| 2133535 | 7/1984 | United Kingdom . |

*Primary Examiner*—Richard A. Rosenberger
*Attorney, Agent, or Firm*—Cohen, Pontani, Lieberman & Pavane

[57] ABSTRACT

A method and apparatus for identifying a moving web in a paper making machine are disclosed. The method includes of the steps of illuminating the web with the light from a transmitter, reflecting the transmitted light off the web, receiving the reflected light with a light transducer to produce an electrical signal corresponding to the intensity of the received light, and identifying the moving web based on the received signal. The intensity of the transmitted light is adjusted so that the received light signal from the transducer is normalized with respect to an optimum value. The apparatus includes a light transmitter, a light receiver, and a control and identification circuit which identifies the web based on a signal from the light receiver, and which adjusts the intensity of the light transmitter to optimize the reception of the signal from the light receiver in order to minimize the effects of environmental interference.

16 Claims, 5 Drawing Sheets

METHOD AND DEVICE FOR PHOTOELECTRIC IDENTIFICATION OF A MATERIAL WEB

This is a continuation of U.S. application Ser. No. 07/719,762, filed Jun. 24, 1991now abandoned.

FIELD OF THE INVENTION

The present invention concerns a method of identification of a moving material web, wherein a beam of light is directed at the material web by means of a transmitter device, and the beam of light produces a reflected beam of light, from the face of the material web to be identified. The reflected beam of light is converted by a receiving device into an electric signal, on which basis the presence, quality, condition, and/or position of the material web is identified.

Further, the invention concerns a photoelectric device for measuring the presence of a material web, in particular of a paper web moving a paper machine or a paper finishing machine, comprising a measurement head, in connection with which there is a light transmitter producing a beam of light, or transmitting a beam of light from a fiber-optic cable. The beam of light is directed at the material web to be identified, and the device includes a light receiver or fiber optics, from which an electric signal is obtained and on which basis the identification of the material web is carried out.

BACKGROUND OF THE INVENTION

In paper machines and similar devices, in which a continuous material web is manufactured or employed, it is often necessary to identify the presence of the material web or the location of its edge in various stages of the process. For these purposes, as a rule, photoelectric means of identification are used. The prior art devices for identification of the web usually operate so that the source of light and the photocell are placed on opposite sides of the web to be monitored, and a break of the web and/or shifting of the edge results in the photocell receiving the beam of light, and as a result transmits an impulse, which results in the alarm and possibly in other action.

In addition, various devices of identification are known which are based on reflection of light from the material to be monitored and on changes occurring in the nature of the reflection. As an example of such devices, reference is made to the U.S. Pat. No. 4,146,797, wherein a device for identification of the location of the edge of a material web is described. This device comprises a source of light and a detector of light. The source of light acts to direct a spot of light on the lateral area of the web to be monitored. The position of the lateral area of the web is monitored and detected on the basis of changes taking place in the intensity of the reflected light.

The prior-art photoelectric devices of identification do no operate adequately under all conditions, and are subject to disturbances. They require constant supervision, frequent calibration and cleaning. In particular, the conditions present in paper machines are an operational environment that imposes very strenuous requirements on transducers because of high temperature, moisture and impurities, which produce errors and false readings in the prior-art photoelectric means of identification. With increasing speeds of paper machines, these problems have increased further.

For example, in a paper machine, a false-positive break alarm with the resulting restarting operations usually causes a standstill of at least about one hour, because the restarting of the paper machine requires a number of steps, including the threading of the web through the machine. Thus, with the prior-art devices, false-positive or false-negative alarms cause considerable economic losses and a reduction of the overall efficiency of operation of the paper machine. A particular problem occurs in areas of single-wire draw in the drying sections of paper machines, where the web is constantly supported by a drying wire. In such a case, by means of the identification device, it is necessary to be able to distinguish the web from the drying area, and a source of light and a photocell placed on opposite sides of the web and the wire cannot be used, and it is necessary to resort to the reflected light from the object to be examined. Moreover, contamination of the wire and variations in the color and the moisture content of the paper web to be detected cause changes in the intensity of the reflected beam of light, making the identification by means of the prior-art devices uncertain.

The operation of the prior-ann web-identification devices is also disturbed by background light, which may vary in intensity, and may include oscillations of fluorescent lamps arising from the line frequency. In the environment of a paper machine, there is also a considerable amounts of infrared radiation, to which most photocells are sensitive, which also causes disturbances in the photoelectric identification device.

OBJECTS OF THE INVENTION

One object of the present invention is to provide such a novel method and device for identification of the presence of a moving material web and, in special cases, also of the presence or location of the edge of a web that the drawbacks discussed above can be substantially avoided.

It is a particular object of the invention to provide such a method and device for identification of a web suitable for use in a paper machine or in paper finishing machines that is more reliable in operation than the prior-art devices so that false alarms to not occur and, on the other hand, correct alarms are not omitted, the objective being to increase the precision of operation of the paper machine.

It is a further object of the invention to provide a photoelectric identification device of the sort concerned, whose interference distance, i.e. signal-to-noise ratio, is higher than in prior art.

It is a further object of the invention to provide a device that does not require repeated calibration, constant supervision or cleaning at short intervals.

It is a further object of the invention to provide a device with a degree of intelligence and which monitors its own operation to that it adapts and optimizes its operation to adapt to an altering operational environment by collecting information from said environment.

SUMMARY OF THE INVENTION

The further objectives and purposes of the invention come out from the following description.

In view of achieving the objectives stated above, the method of the invention is mainly characterized in that, in the method, the intensity of the beam of light transmitted from the transmitter of light is regulated on the basis of the intensity of the reflected beam of light, and that the reference level or levels of the electric identification signal derived from the reflected beam of light is adapted in compliance with the environment of operation so as to optimize the identification and to minimize interference from the environment.

The device in accordance with the present invention is characterized in one aspect of the invention in that the device comprises a signal-processing part for the electric signal obtained from the light receiver, which further comprises a microprocessor, to which the analog signal obtained from said signal-processing part is passed through an A/D converter, that said microprocessor is connected to control the regulation unit for regulating the intensity of the light to be transmitted, the regulation unit controlling an adjustable voltage source and that, from said voltage source, a regulated voltage is supplied to the light transmitter so that the operation of the device is adapted to the environmental conditions and that any interference with the operation is minimized.

In a preferred embodiment of the invention, the photoelectric identification device transmits a constant or pulsating light towards the face of the material web and measures the amount of light reflected from the face. When pulses of light are used, during the intervals between the pulses the detector measures the so-called dark level, i.e. the effect of the environmental light, and subtracts this amount from the amount of light detected at the time of transmitted light pulse. In this way, detrimental effects of external disturbances can be eliminated or compensated. When the web material is changed, the amount of reflected light is reduced or increased, depending on the case. The detector of the invention can make a decision about the nature of the change of the reflected light received by consideration of the speed of change and other influencing factors.

In the method and device in accordance with the invention, preferably a microprocessor controls the operation although any programmable sequencing device can be used. As the identification light, visible light is used which preferably penetrates through the paper as little as possible and whose reflection characteristics from the web and from the wire are different. The frequency of the light should preferably be sufficiently far from the frequency range of the spectrum associated with a fluorescent tube so that the latter may be used for normal illumination without interfering with the detectors. An example of a suitable wavelength of the light is $\lambda$=670l nm.

The detector in accordance with the invention is preferable arranged such that it is calibrated automatically at suitable intervals on the basis of sequences programmed in the microprocessor.

The advantages of the invention are apparent particularly in paper machines and in paper finishing machines to indicate the presence of the edge of a paper web, especially in the indication of the position of the wire or paper. In a paper machine, web sensors of the present invention may typically be used for monitoring the presence of the paper web on the face of a drying wire or a roll in the paper machine, the position or condition of the paper web and/or the wire edge in several different positions, or detecting the presence of the paper web at free draws of the web.

Besides paper machines, advantageous areas of application of the present invention are in various paper finishing machines, such as calendars, coating devices, winders and slitterwinders, and in printing machines.

In some cases, the method and the device in accordance with the invention is also suitable for use in processes other than paper machines, such as, for example, processes that manufacture or process various material flows, such as plastic films or the like.

BRIEF DESCRIPTION OF THE DRAWINGS

In the following, the invention will be described in detail with reference to some exemplifying embodiments of the invention illustrated in the figures in the accompanying drawings, in which.

DETAILED DESCRIPTION OF THE PREFERRED EMBODIMENTS OF THE INVENTION

Figure 1:
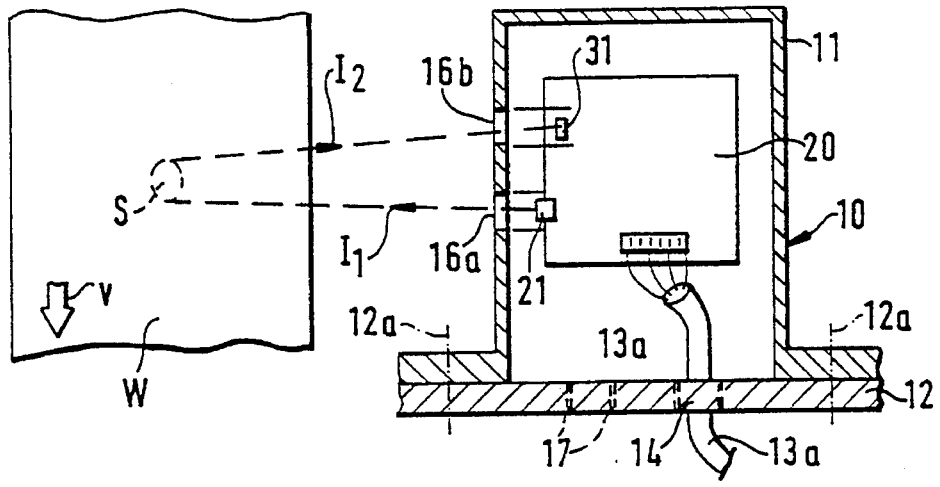
FIG. 1 is a central sectional view of a measurement head used in the invention, in connection with which an electronic circuit board is fitted.
Figure 2:
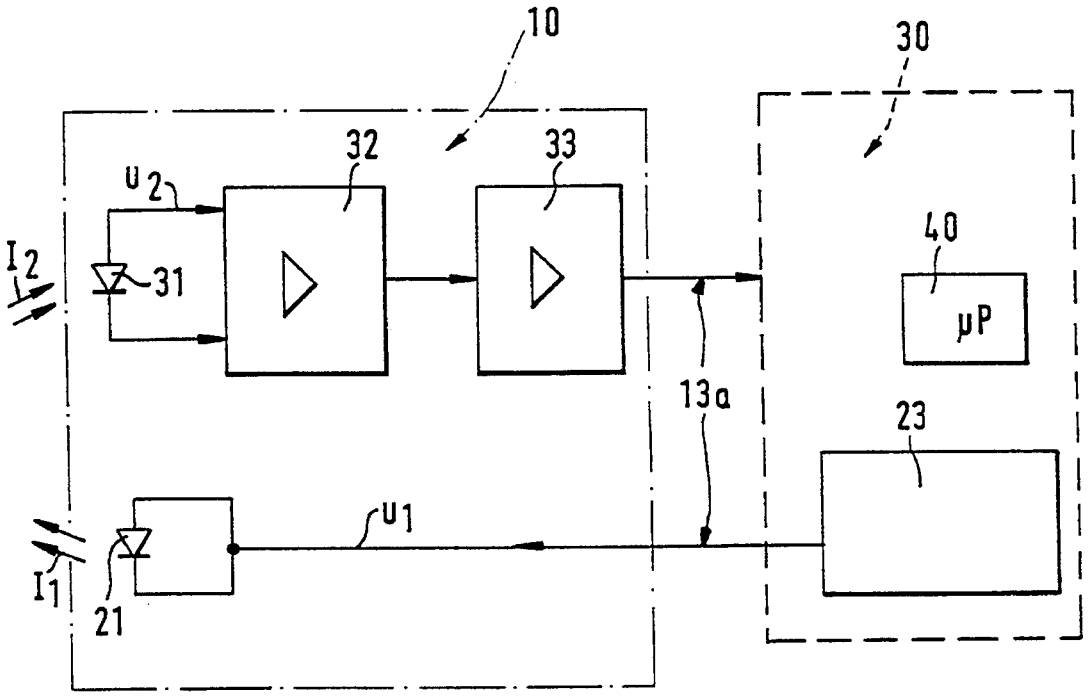
FIG. 2 shows a block diagram of a device as shown in FIG. 1.

As shown in FIG. 1, the measurement head 10 comprises a cylindrical protective casing 11, to which a bottom flange 12 has been attached by means of screws 12*a*. Inside the casing 11, there is an electronic circuit board 20, to which an electric cable 13*a* passes through a lead-in 14. To the electronic circuit board 20, a light transmitter 21, e.g. a light emitting diode (LED), is connected, which emits a transmitted beam $I_1$ of light through an opening 16*a* in the casing 11 toward the web W, which moves at the velocity v and whose presence and breaks in which are monitored. From the area of the spot S lighted by the transmitted beam $I_1$ of light, a reflected beam $I_2$ of light is reflected back to the measurement head 10. The reflected beam $I_2$ of light is detected through an opening 16*b* in the casing on the light receiver 31, e.g. a photo-diode, on the electronic circuit board 20. The light transmitter 21 receives its control voltage through the cable 13*a*, and by means of the cable 13*a* the voltage signal of the light receiver 31 is passed to the identification system 30. As is shown in FIG. 2, the light transmitter 21 receives its regulated voltage $U_1$ from the adjustable voltage source 23, and, in a corresponding way, the output voltage $U_2$, which is proportional to the reflected beam $I_2$ at the light receiver 31, is passed through the amplifier 32 and the high pass filter 33 to the identification system 30, whose functions are controlled by a microprocessor 40. A more specific exemplifying embodiment of the operational construction of the identification system 30 will be described in detail later, mainly with reference to FIG. 5.

Figure 3:
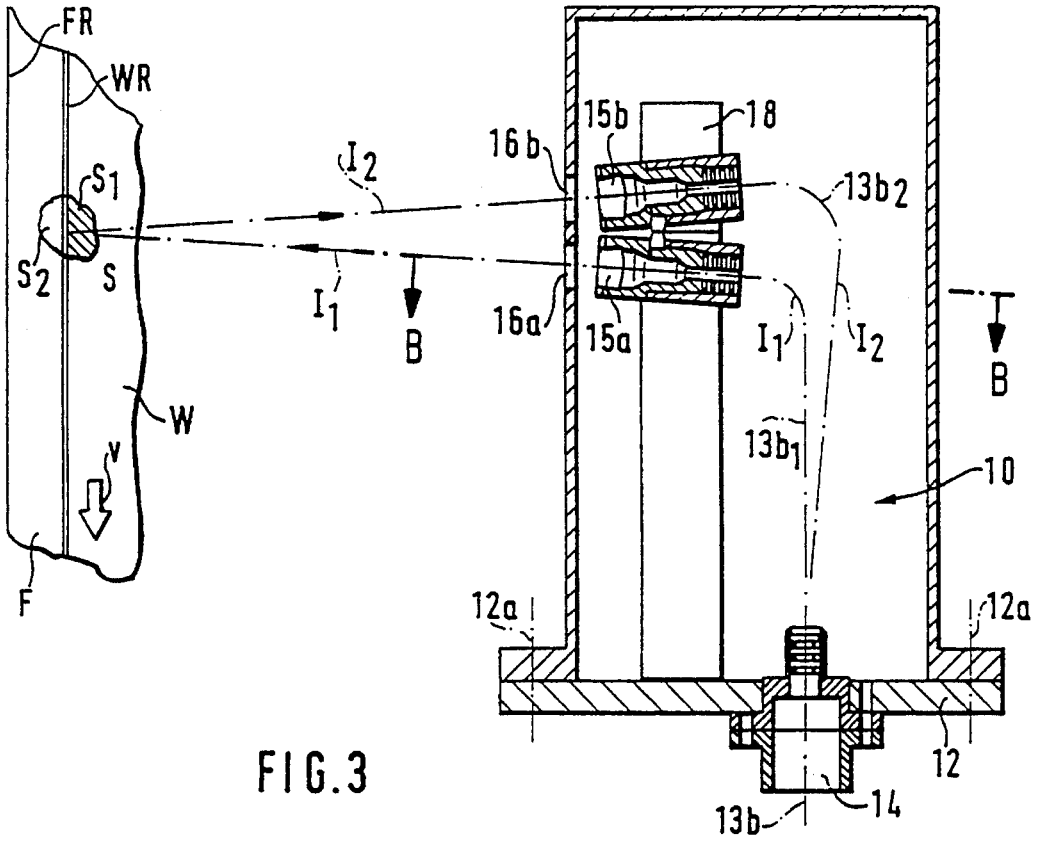
FIG. 3 shows a measurement head in accordance with the invention to which the light signal is passed by means of a fiber optic cable and is shown as a sectional view taken along the line A—A in FIG. 4.
Figure 4:
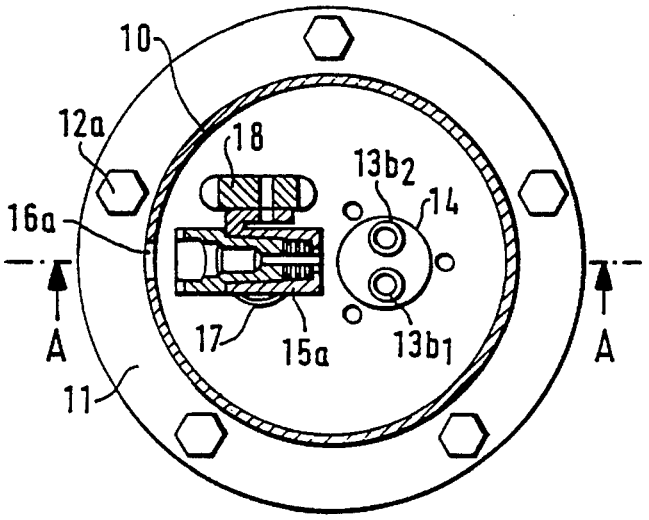
FIG. 4 is a sectional view along the line B—B in FIG. 3.

In FIGS. 3 and 4, such an embodiment of the invention is shown in which the light signal Iis passed into the casing part 11 of the measurement head 10 by means of the fiber optic cable 13*b* by making use of the transmitting fiber optic cable portion 13*b*$_1$. The beam $I_1$ of light is focused through the optics 15*a* and the opening 16*a* onto the Web W to be monitored, from whose light spot S, from its medial portion $S_1$, a beam 12 of light is reflected, which is received through the opening 16*b* by means of the optics 15*b*, being passed further through the receiving fiber optic cable portion $13b_2$ to the system 30, which comprises a light transmitter 21 and a light receiver 31. The fiber optic light cable 13*b* is passed into the system 30 through a lead-in 14. The lenses 15*a* and 15*b* are connected to the casing 11, in connection with the bottom flange 12, by means of a holder 18. To keep the casing 11 clean, pressurized air is passed through lead-in openings 17, which are also provided in connection with the measurement head shown in FIGS. 1 and 2, into the casing 11. The air is discharged through the apertures associated with the lenses of the optics 15*a*, 15*b* and through the openings 16*a*, 16*b*, thereby keeping the optics 15*a*, 15*b* and the openings 16*a*, 16*b* clean of paper pulp, dust and other impurities.

FIG. 3 illustrates the invention in a mode of operation in which the location of the edge $W_R$ of the web W, which moves at the velocity v, is detected. The web W moves on the wire F as a support. In a corresponding way, it is possible to monitor the presence of the web W only, rather than its edge. It is also possible to monitor the presence of the location of the edge $F_R$ of the wire F, or the condition of the lateral area of the wire between the edge $W_R$ and the edge $F_R$. Measurement of the position of the edge $W_R$ of the web W and/or of the edge $F_R$ of the wire F is based on the fact that the mutual proportions of the medial portion $S_1$ and the lateral portion $S_2$ of the light spot S that reflect in different ways and thereby influence the intensity of the reflected beam $I_2$. In the monitoring of the edge $F_R$ of the wire F, the portion $S_2$ of the spot S is outside the wire F, from where no reflection takes place.

Figure 5:
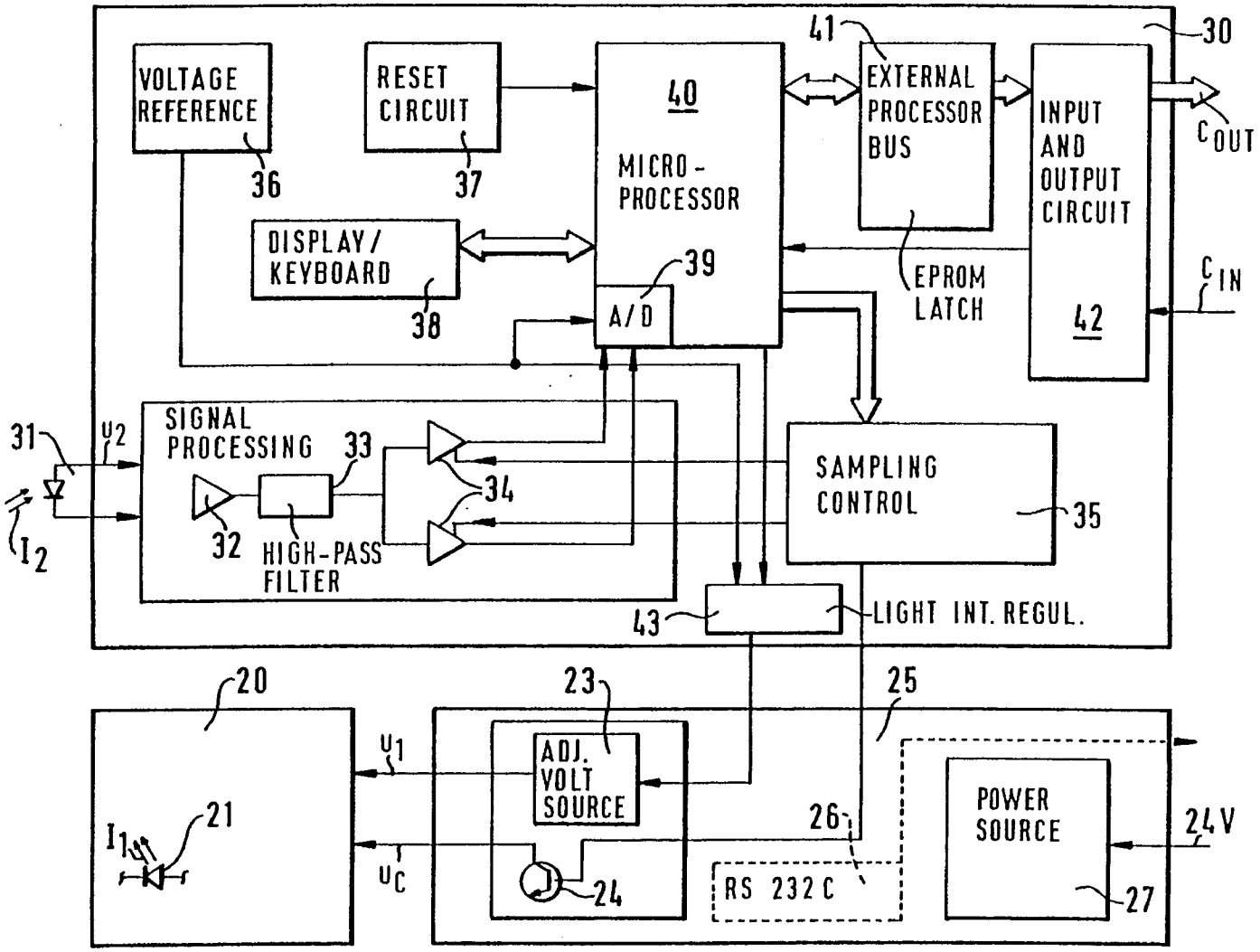
FIG. 5 shows a block diagram of a system of identification in accordance with the invention.

FIG. 5 shows an exemplifying embodiment of the identification system 30 in accordance with the invention. The system 30 receives an output voltage $U_2$ signal, which is related to an intensity of the reflected beam $I_2$ reflected from the web W to be monitored, from the light receiver 31 of the measurement head 10. The output voltage $U_2$ signal is transmitted to the signal-processing section, which comprises an amplifier 32 and a high-pass filter 33. The high-pass filter 33 essentially blocks the time invariant portion of the signal and allows a signal spectrum which is higher than a certain limit frequency to be passed through to the gate circuits 34 and ultimately through to the Analog-to-Digital (A/D) converter 39, hereinafter referred to as the A/D converter 39, to the microprocessor 40. The microprocessor 40 is connected with a voltage reference 36, a reset circuit 37, and with a display/keyboard 38. By means of the gate circuits 34, samples are taken from the output voltage $U_2$ signals from the light receiver 31 processed by the amplifier 32 and high-pass filter 33. These samples are passed to the A/D converter 39 of the microprocessor 40. The sampling by the gate circuits 34 is controlled by the sampling-control circuit 35, which is controlled by the microprocessor 40. Further, by means of the sampling control circuit 35, the switch transistor 24 of the drive unit 25 is controlled, producing control signal $U_2$ which causes the transmitted beam $I_1$ of the light transmitter 21 of the electronic circuit board 20 of the measurement head 10 to be pulsed at the sampling interval of the sampling control circuit 35. The drive unit 25 further includes an adjustable voltage source 23, which is controlled by the light intensity regulation circuit 43 so that the light transmitter 21 receives a suitable regulated voltage $U_1$ input in accordance with the control of the system 30, and an intensity of the transmitted beam $I_1$ is varied in accordance with said regulated voltage $U_1$ .

An external processor bus 41 is connected to the microprocessor 40, which is further connected with input and output circuits 42. Through the input and output circuits 42, the output signals $C_{out}$ passing out from the system 30 are obtained, such as the alarm signals or measurement signals, e.g., concerning the position of the web W or the edge $F_R$ of the wire edge F. In a corresponding way, from an external system, e.g. from the process control computer of a paper machine, the necessary control signals $C_{IN}$ are obtained for the system 30. The unit 25 further includes a power source 27 and a serial interface circuit 26, which may be, for example, an RS-232 standard interface or the like.

Figure 6A:
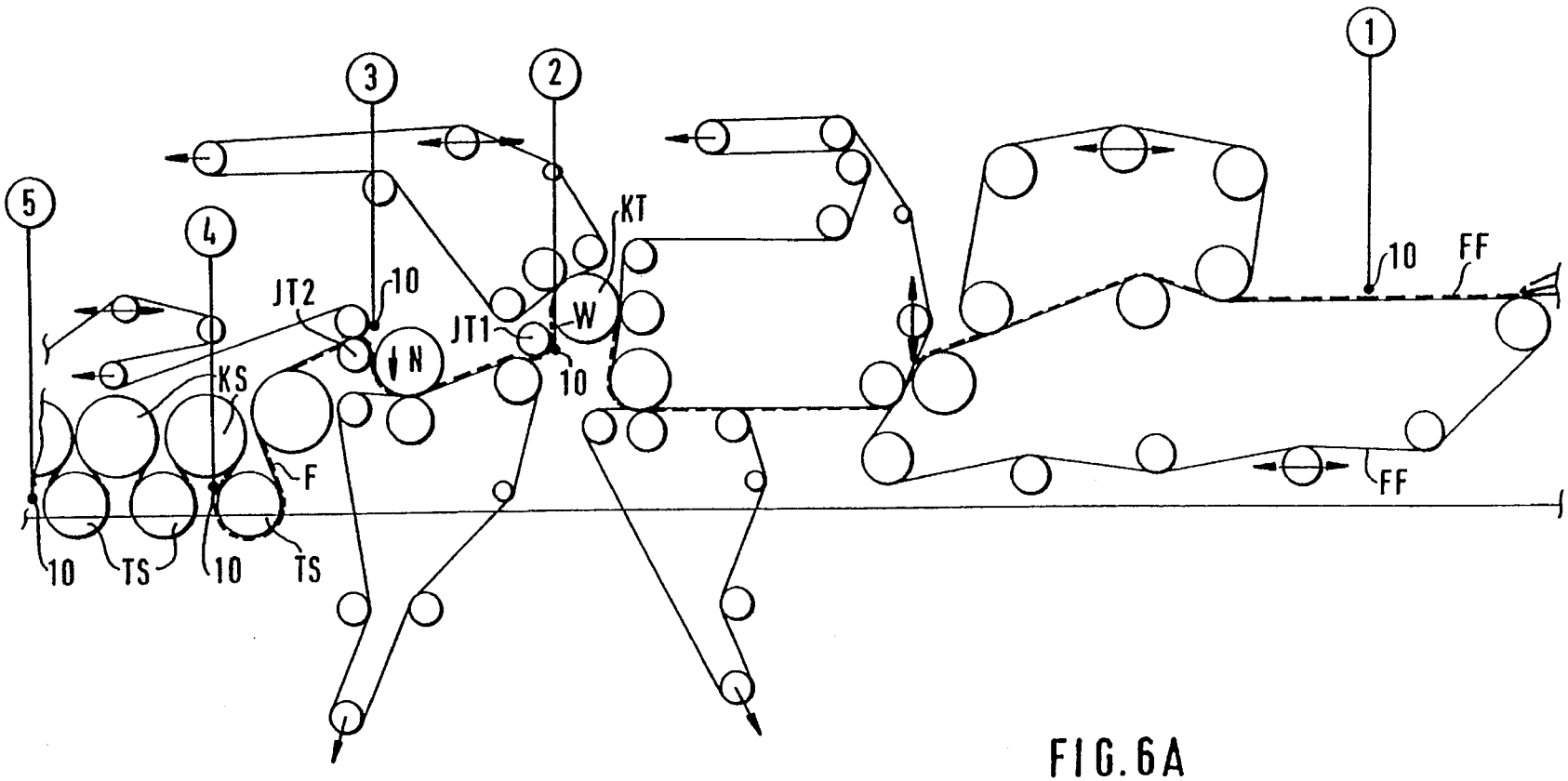
FIG. 6A shows different locations of an identification measurement head in accordance with the invention in the former, press section, and the initial end of the drying section in a paper machine.
Figure 6B:
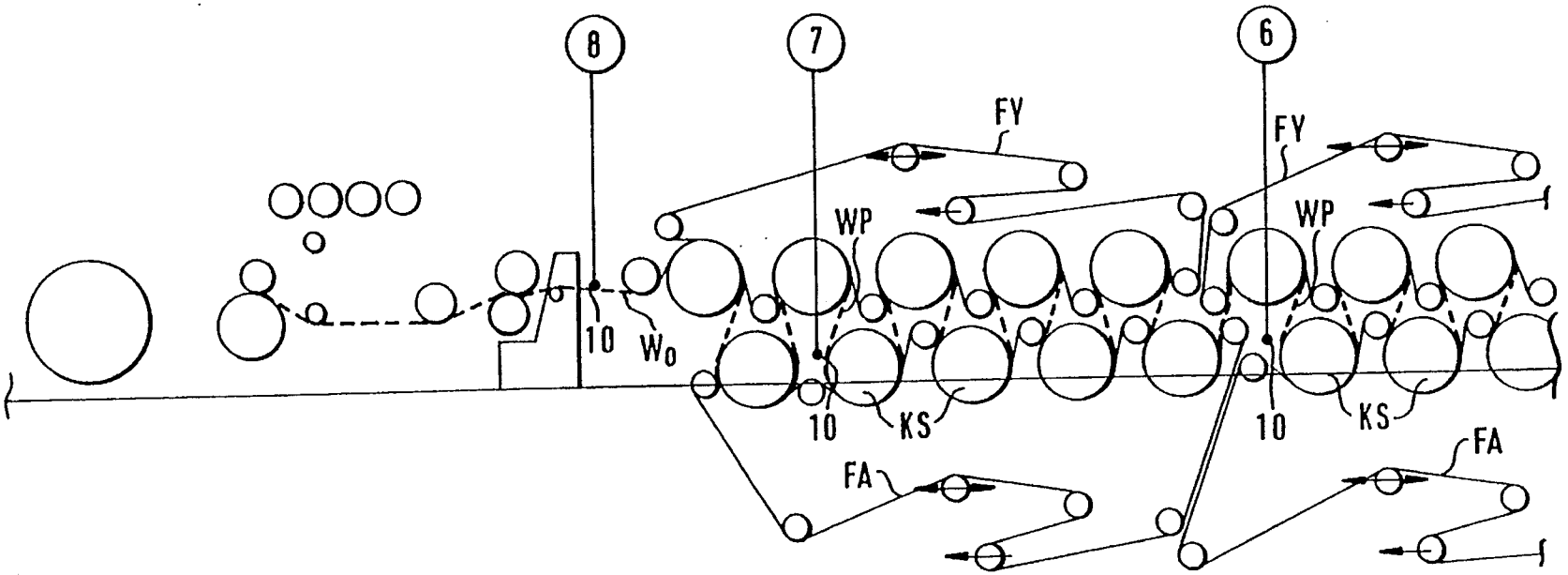
FIG. 6B is a continuation of FIG. 6A and shows alternative locations of a measurement head in accordance with the invention in and after the final end of the drying section in a paper machine.

FIGS. 6A and 6B show some advantageous locations in a paper machine of a measurement head 1G in accordance with the invention. All of the measurement heads 10 shown in FIGS. 6A and 6B are not necessarily needed at one time nor need they be of identical design. According to FIG. 6A, a measurement head 10 is placed in position 1 to monitor the location and/or the condition of the edge of the forming wire FF. In position 2, a measurement head 10 is placed after the center roll KT in the press section to monitor the presence of the web W on the guide roll JT1, whereupon the web W runs into the separate last nip N in the press section. In position 3, a measurement head 10 is placed after the last nip N to monitor the paper web W on the face of the guide roll JT2, whereupon the web W is passed into the drying section, in connection with whose leading heatable drying cylinder KS, in position 4, a measurement head 10 monitors the web W. The same operation takes place in position 5 of the measurement head 10. In the upper row, the drying section comprises heatable drying cylinders KS, and in the lower row leading cylinders TS, over which the drying wire F is passed along a meandering path so that, on the heatable drying cylinders KS, the web W reaches direct contact with the heated faces of the heatable drying cylinders KS, and on the leading cylinders TS the web is outside.

In FIG. 6B, which is a continuation of FIG. 6A, in position 6, a measurement head 10 is placed to monitor the paper web W on the face of the heatable drying cylinder KS. The measurement head 10 in position 7 has a corresponding function. In FIG. 6B, the cylinder groups in the drying section are cylinder groups provided with twin-wire draws, wherein there are two rows of heatable drying cylinders KS, one row placed above the other, as well as an upper wire FY and a lower wire FA as fitted so that the web W runs as a free draw WP between the rows of cylinders. In position 8, the measurement head 10 monitors the paper web after the drying section in the free gap $W_0$. Besides the positions shown in FIGS. 6A and 6B, the invention can also be applied in various positions in paper finishing devices.

Even though in the above description, the invention has been described expressly in relation to paper machines and to paper finishing devices, the invention can also be applied to other, corresponding monitoring functions, e.g. in connection with various material webs, such as plastic webs or paper webs moving in printing machines.

As the light transmitter 21, for example, super-bright light emitting diodes (LEDs) are used, which operate in the range of visible light (e.g., $\lambda$=670 nm). Light is modulated under control of the microprocessor 40 so that the length of one measurement cycle is, e.g., 1 ms and the length of a light pulse is 50 μs. When modulated light is used, when the ambient light is measured, and when programmed signal processing is employed, the effect of the light in the environment on the measurement may be eliminated or substantially reduced. Particular attention is given to the frequency ranges of 50 Hz to 60 Hz and to their harmonics which often occur in artificial lighting. The transmitted light level can be regulated within a wide range, depending on the mode of operation, either by means of an external command or automatically. It is preferable to keep the level of the received beam $I_2$ received from the paper web W substantially invariable by regulating the intensity of the transmitted light $I_1$. This allows the receiver to operate within an optimized narrow range.

Under normal operating conditions, the light receiver 31 will receive the reflected beam $U_2$, and will produce the output voltage $U_2$ which will be substantially invariant with respect to time, containing minor fluctuations related to variations in the reflected light from the web, environmental light variations, interference from particulates, and the like. Thus, large changes in the output voltage $U_2$ represent events, such as a change in state of the web, or a possible failure of the identification device.

The source of light is preferably chosen so that, when the optical system is clean, for example, about 10% to about 30% of the available light capacity is in use. More preferably, about 20% of the available light capacity is in use.

As a result of the pre-treatment of the signal, for processing by the microprocessor 40, a signal is received whose level is proportional to the amount of light in the reflected beam $I_2$ collected from the light pulse of the light transmitter 21, from the face of the web W or other object to be monitored, by means of the optics 15*a*, 15*b*. When mirror-type reflections are eliminated in the installation stage, the signal level is proportional to the reflectivity, i.e. brightness, of the surface to be examined. The signal is compared with the reference levels set in the identification system 30, and, on the basis of the results of the comparison, a decision is made, i.e., "web on" or "web off".

One reason why the light receiver is to be operated at a substantially invariant output voltage $U_2$ is because often the devices used, e.g. photodiodes, are non-linear with respect to received light intensity. By operating the device at a predetermined operating point, the control section need not perform calculations or process the signal in order to compensate for these nonlinearities. Of course, these calculations and/or compensations could be implemented, which would allow a wider range of operation and still operate within the scope of the present invention. For example, the signal processing section of FIG. 5 could be modified to include a linearization circuit which would compensate for changes in the operating point of the light receiver 31 due to changes in ambient conditions. Further, the microprocessor 40, which is a programmable sequencing control device, could be programmed to linearize the output voltage $U_2$, after processing by the amplifier 32, high pass filter 33, and gate circuit 34, as digitized by the A/D converter 39. The microprocessor 40 could also compensate such values as the reference levels, alarm points, and the like. In addition, the microprocessor 40 could assume the burden of filtering and sampling if the digitizer portion operates above the Nyquist rate of the output voltage $U_2$ . The Nyquist rate is a sampling rate at least two times the highest frequency component present in the signal. In such a case, the amplifier 32 usually is implemented as having both a gain and a high frequency fall-off, i.e., a low pass filter, so that the interfering high frequencies are eliminated. It is also noted that the A/D converter 39 can be a part of a microcomputer circuit, or a separate component and may be of any known type of circuit which converts an analog signal to a signal compatible with digital logic circuits, such as a successive approximation register converter, using resistive or capacitive methods, a flash converter, a voltage to frequency converter, a delta-sigma converter, an integrating type converter or the like.

The high pass filter 33 may be of any known type, or implementation, including an active or passive resistor-capacitor-inductor network, a switched capacitor-type filter, or a digital filter. If the high pass filter 33 is a digital filter, then it would be preceded by the A/D converter 39, and could be implemented as a part of the microprocessor 40. The gate circuits 34, for sampling the output voltage $U_2$, as processed, sample at the time of the light pulse of the transmitted beam $I_1$, and also sample to measure the ambient illumination when the transmitted beam $I_1$ is off or not present. The gate circuit can be of any known type, such as a capacitive charge storage sample-hold amplifier or the like. Of course, these sampling circuits 34 can be implemented at any stage of the processing, in the analog signal processing section or in the microprocessor 40. Thus, the high pass filter 33, the gate circuits 34, and the A/D converter 39 may all be implemented in various ways, without going outside the scope of the present invention.

Due to changes in various conditions, e.g. contamination, the system must be calibrated from time to time. The making of the decisions and the calibration may take place in different ways depending on the mode of operation of the device, of which there are two: the MANUAL mode and the AUTO mode, which will be described in the following.

MANUAL mode

In the MANUAL mode of operation, the device is calibrated by means of an external command, control signals $C_{IN}$, e.g. by means of an external knob or button. The calibration is carried out while the web W is in an "on" state. During calibration of the device, the output voltage $U_2$ from the light receiver 31 sensing element (e.g. a photodiode) must be set, under normal operating conditions, to be at a predetermined operating point. Since the output of receiver 31 is positively related to the reflected beam $I_2$ from the transmitted beam $I_1$ of the transmitter 21 (e.g., a light emitting diode), the received signal level can easily be adjusted by the microprocessor 40 by inputting a compensating value into the light intensity regulator 43, which controls a output voltage $U_1$ from the adjustable voltage source 23, which sets the transmitted light intensity from the light transmitter 21. Further, a reference level, as a part of decision-making logic, is recalculated in accordance with a set percentage value of the actual signal level from the light receiver 31.

The MANUAL mode of operation may also encompass a mode of operation in which the device performs the above described calibration operations at preset intervals, independent of operator intervals, if it, at that time, interprets that the web W is in an "on" state. Thus, in the MANUAL mode with calibration at preset intervals, it is possible for the device to compensate for variations in the normal operating conditions.

The purpose of the calibration is thus to compensate for attenuation of the signal $U_2$ as a result of contamination of the measurement head and to adapt the detector to altered measurement conditions, e.g. for papers of different color.

The decision "web on/off" is made by the identification system 30 on the basis of the reference level calculated during the calibration sequence, i.e. when the signal level is lower than the reference level by a threshold amount, a web break has been determined to have occurred and the web is determined to be in an "off" state. The output signals $C_{out}$ consist of two relay outputs, "web on" and "web off", which are opposite in phase.

AUTO mode

In the AUTO mode of operation, no separate calibration sequence exists. Rather, the signal level $U_2$ is maintained at an invariable level at all times irrespective of whether the web W is "on" or "off". In the AUTO mode, two reference levels are used, one of which is calculated as a preset percentage below the signal level and the other one, correspondingly, above the signal level. The reference levels are determined by filtering the instantaneous value of output voltage $U_2$ signal level from the receiver 31, by processing the data sequence received by the microprocessor 40 from the A/D converter 39. The filtering coefficient is adjustable. In fact, since the microprocessor 40 is acting as a digital signal processor, the "filtering" function need not be limited to simple filtering types, and a filter of any desired degree of complexity and of any type may be implemented. In this mode of operation, the device detects rapid changes in the signal level, but the outputs do not represent the absolute state "web on/off". Rather, when the paper web W is broken, the output voltage $U_2$ signal level decreases rapidly. In this case, a pulse-shaped "web off" relay output is produced. The pulse length is determined by the predetermined filtering coefficient of the above described filter. The "web on" output operates analogously, such that when the paper web passes, a pulse-shaped "web on" relay output signal results. In a static state, where no change in the "web on" or "web off" decision state, and both of the relay outputs are in the OFF state.

The AUTO operation mode is chosen by means of a mini jumper, placed in the electronics module in an appropriate location. For the other settings, e.g. the reference level, the electronics module has a display/keyboard 38 unit. The set values are stored in a nonvolatile memory protected from electrical failure (EEPROM). There is no necessity for auxiliary measurement devices in order to calibrate or adjust the device. For example, the regulated voltage $U_1$ and the light intensity value as represented by the output voltage $U_2$ can be displayed on the display/keyboard 38, as well as a code indicating any cause of an error alarm.

In the following discussion, the dimensionless numbers are exemplary only, and these may of course vary within certain limits. The set values are 0 to 99, with the exception of the guide value 0to 255 of the signal level. The reference levels are given as percentages and the other values either as coefficients or as a numerical value directly corresponding to a part of the measurement signal.

DETAILED DESCRIPTION OF THE PREFERRED EMBODIMENT

The Web Material Photoelectric device of the present invention can be installed on, for example, a paper machine. If the A/D converter 39 is an 8-bit converter, then the output range is from 0to 255 (OO to FF). In this instance, an output of 255 (FF) represents an input voltage of about 5.0 or 5.12 v. The output voltage $U_2$ level from the receiver 31, through the signal processing section, including the amplifier 32, high pass filter 33, and sampling circuits 34 is set to be 100, or about 2 V. A tolerance is allowed of about ±5, thus, the actual mean signal is received by the microprocessor through the A/D converter 39, is from 95to 105. Further, a reference level is set as a percentage of the received signal during calibration, e.g. 30%. This reference level is implemented as a one sided discrimination window, thus, a (–) 30% reference level with a received signal of 100 would result in a perceived alarm condition if the actual received signal level was 100×(100% –30% )=70 and the web W is more reflective than the wire F. Of course, if the web W is less reflective than the wire F, then a reference level may be (±) 30%, and the discrimination level 130. The filtering coefficients are predetermined in this instance, and the filter may be, e.g., a 32 tap Infinite Impulse Response IIR filter implemented in the microprocessor 40 approximating a Butterworth filter. The lower alarm limit of the signal is also predetermined, e.g. 06. The lower alarm limit serves as a fail-safe mechanism in the event of device failure to prevent false positive alarm conditions.

The calibration is carried out as follows. When the web W to be monitored is at the measurement point of the spot of light S, the device is given an external calibration command. The device attempts to adjust the voltage of the light transmitter 21 LEDs so that the receiver receives an amount of light which results in a signal level equal to the preset signal level, within the tolerance band, i.e.95to 105. The device then calculates the reference level as equal to the given percentage value, i.e., when the measured value is 100, the reference level is 70%, i.e. 100 less 30%. If the web W to be monitored reflects less light than the background material does, then a reference level is calculated that is higher that the standardized signal output.

The measurement and decision making are carried out as follows. When the measurement is enabled and after the signal level has been stabilized after calibration, e.g., at 100, an internal clock of the device starts counting. After the web W has been on, e.g., for 2 hours, the device performs a calibration operation automatically. If the signal has slowly dropped below 95 or risen slowly above 105 (100–5 or 100+5), then the change exceeds the tolerance and the output level is adjusted to return to normal operating conditions and to set the receiver 31 signal level to between 95 to 105 by adjusting the light transmitter 21 output. If the signal is in the range of 95 to 105, no change in calibration is necessary or is performed. After the calibration, the device calculates new reference levels based on the actual normalized input signal. If the received signal $U_2$ is lowered to below the reference level and stays below that level for the time of the operational delay, the error condition decision is made whereby it is ascertained that the web W to be monitored is not longer present, resulting in a "web off" output signal.

After normalization of the signal input or other event which causes an abrupt change in the output signal level, the measured signal output from the filtering section can be stabilized by temporarily altering the filter characteristics so that it has a filtering coefficient of 1. The period for which this initialization operation takes place is determined by the nature of the filter itself and the settling period. The filter samples the signal with a delay of, e.g., about 20 mS.

For example, if the filter has 32 taps and requires 256 sampling periods to settle within ±5 of the actual value as a result of a step input, then the total settling time will be 256 ×20 mS=5120 mS or about 5 seconds. If the filter coefficients are temporarily changed to 1, thus eliminating the long term memory of the filter, then, assuming again that the filter has 32 taps, the total settling time to ±5 of the actual value would be, as a result of a step input, assuming 32 time delays to complete convergence, e.g., 30×20 mS=600 mS or slightly more than one half second. This difference could prove important in improving the reliability of the device in a starting operation. Of course, all of the registers of the digital filter could be preloaded, providing a minimal delay on startup.

If the measurement signal falls to a level below the alarm limit of the signal, 06, for a period in excess of the operational delay time, the electronic system generates an error alarm, and during that period the device constantly indicates that the material W to be monitored is present at the position of the spot of light S, i.e., "web on". Thus, the effect of false alarms is prevented. The decrease in the signal to such a low level may be due to the following causes: the fiber optic cables 13*b* are broken, the receiver inoperative, impurities or foreign particles in the light path or obstructing the light spot S, in which case the beams of light are not reflected to the light receiver 31. While these should be corrected, their occurrence is not sufficient reason to shut down the machine.

After the device has been in operation for a long time, the fibers in the fiber optic cable 13*b* may be aged, in which case their light carrying capacity is lowered, or the ends of the fibers may be contaminated, in which case the regulated voltage $U_1$ of the light transmitter 21 LEDs must be increased. When the regulated voltage $U_1$ cannot be increased further, a normalization failure alarm is given, which indicates that the adjustment of light output is at a maximum. The device operates essentially normally in spite of this condition. When the signal level is lowered, e.g. from 100 to 80, correspondingly the reference level is lowered from 75 to 56. Of course, if nonlinearities of the sensor after the reference level, the new reference level could be adapted to this condition.

These conditions should also be corrected, but this can be deferred until the machine is shut down for other reasons or during routine maintenance.

It should be noted that the discrimination circuit of the present device can also be of a different type than that described in the preferred embodiment, i.e., one that incorporates fuzzy logic or neural network technology. Further, the filter organization need not be of a predetermined type, but rather may be adaptive, such that the degree of precision of decision making is improved. For example, if the paper and the wire have similar reflectivities, a discrimination may still be conducted based on a variation in reflectivity pattern of the moving wire and web over time or on a difference of patterns imposed on the paper and the web.

The microprocessor 40 may also implement an adaptive signal recognition algorithm wherein, during normal operating conditions, the normal fluctuations in the signal are analyzed to yield a normal signature pattern. In this case, any change of that pattern may be indicative of a change in the condition of the apparatus, and may indicate an impending device failure or breakage of the web. This change in pattern may be used to vary a process parameter in order to minimize the risk of a machine shutdown. The possible error conditions will become better known over time, so that in addition to comparing the received signal to the normal pattern, the microprocessor 40 could compare the received signal to the known patterns of impending device failure or error conditions. Thus, the processor can adaptively vary its decision levels based on the known states of the paper machine or other machine in which the device is used, in order to improve its speed and accuracy of detection. For example, if an abnormal condition in a prior section of the machine initially causes a repetitive variation in the reflectivity pattern of the material web, even before it necessitates device shutdown, then this condition could be detected by a reflectivity sensor such as that of the present invention and that information could be used to vary a process parameter to alleviate the problem. Even if the problem cannot simply be alleviated, if it is slow in evolution, then it could be dealt with during the next device shutdown or during routine maintenance. The adjustable light intensity normalization of the present invention would be synergistic with these advanced state recognition methods for a number of reasons. First, the normalization allows the receiver to operate an optimum signal level, improving the operation of the transducer. Second, it reduces the number of calculations necessary by the processor in order to further process the signal because the receiver operates around a predetermined operating point.

It would also be possible to operate the detector of the present invention using a closed loop optical feedback system wherein the power output of the transmitter is varied continually in order to maintain a constant received signal level, and the control signal to the light transmitter would serve as the reflectivity output. The output signal could also be pulse amplitude modulated or pulse width modulated in order to achieve a wide dynamic range, reduce the power dissipation of the transmitter, and to allow measurement of the ambient light conditions.

Further, the present invention is adaptable to include a plurality of light sources and a plurality of light receivers. For example, two frequencies of light could be used to provide better selectivity. In such a case, either light signal could be normalized, both could be normalized, or some function of the received signals could be normalized. The light sources may be LEDs, incandescent bulbs, gas discharge bulbs, fluorescent devices, lasers, or any known type of illumination device.

It is also obvious that normalization could take place by varying the pulse width of the transmitter and integrating the received signal over the period of the pulse. The light output of the light transmitter 21 could also remain constant, and the transmitted beam $I_1$ may be intensity and/or pulse modulated instead by an iris, LCD shutter, electrochromic device, or by other known means.

Finally, the light receiver 31 could comprise a number of elements, each receiving a signal that varies in light frequency or spatial location, i.e. a segmented photodiode array, which could serve to define an edge condition of the web. The receiver may be of any type and complexity, including silicon, gallium arsenide, cadmium sulfide, selenium, or other semiconductor compounds, acting as bipolar devices, charge coupled devices or through other known photon detecting methods.

It should be understood that the preferred embodiments and examples described are for illustrative purposes only and are not to be construed as limiting the scope of the present invention which is properly delineated only in the appended claims.

What is claimed is:

1. A method of identifying a state of presence of a web moving on and supported by a wire or felt in a paper making machine, comprising the steps of:

illuminating a portion of the web with a pulse-modulated transmitted beam of light from a light transmitter to produce a reflected beam of light, said modulated beam of light modulating in intensity from an on state to an off state, said reflected beam of light having a first pattern when said web supported by the wire or felt is present and a second pattern when said web is not present and the wire or felt is present, said first and second patterns being different from one another;

detecting said reflected beam of light with a light receiver to produce an electric signal corresponding to the intensity of said reflected beam of light received by said light receiver;

obtaining a background light level from said electric signal corresponding to when said modulated transmitted beam of light is in an off state and said web supported by the wire or felt is present;

obtaining an illuminated light level from said electric signal corresponding to when said modulated transmitted beam of light is in an on state and said web supported by the wire or felt is present and is illuminated by said modulated transmitted beam of light;

processing said electric signals corresponding to said background light level and said illuminated light level by subtracting said electric signal corresponding to said background light level from said electric signal corresponding to said illuminated light level to obtain a calibration signal;

adjusting the intensity of said transmitted beam of light when said web supported by the wire or felt is present so that said calibration signal is normalized; and analyzing said electric signal produced by said light receiver and determining whether the web supported by the wire or felt is present or whether the web is not present and the wire or felt is present.

2. A method according to claim 1, wherein said light transmitter is a light emitting diode and said adjusting step further comprises adjusting an intensity of a transmitted beam of light from said light emitting diode by adjusting an input voltage to said light emitting diode.

3. A method according to claim 1 wherein said adjusting step further comprises adjusting the intensity of said transmitted beam of light such that between about 10% and about 30% of the available total light capacity of said light transmitter is required to normalize said calibration signal.

4. A method according to claim 1, wherein said analyzing step further comprises filtering said electric signal with a high pass filter, and detecting a break in said web based on the occurrence of a rapid change in the filtered electric signal.

5. A method according to claim 1 further comprising detecting an error condition indicative of device failure, in which an electric signal indicative of an error condition is different from an electric signal indicative of a change of presence of the material web.

6. A method according to claim 1, wherein said transmitted beam of light is visible light having a frequency above the spectrum associated with fluorescent light.

7. A method according to claim 1, wherein said step of obtaining a background light level, said step of obtaining an illuminated light level, said electric signal processing step, and said adjusting step are performed at preset intervals.

8. A photoelectric device for identifying a state of presence of a web moving on and supported by a wire or felt in a paper making machine, comprising:

an adjustable light intensity transmitter for illuminating a portion of the web with a pulse-modulated transmitted beam of light to produce a reflected beam of light, said modulated beam of light modulating in intensity from an on state to an off state, said reflected beam of light having a first pattern when said web supported by the wire or felt is present and a second pattern when said web is not present and the wire or felt is present, said first and second patterns being different from one another;

a light receiver for detecting said reflected beam of light to produce an electric signal corresponding to the intensity of said reflected beam of light received by said light receiver;

control means for adjusting the intensity of light transmitted by said transmitter comprising:

means for obtaining a background light level from said electric signal generated by said light receiver corresponding to when said transmitter is in an off state and said web supported by the wire or felt is present;

means for obtaining an illuminated light level from said electric signal generated by said light receiver corresponding to when said transmitter is in an on state and said web supported by the wire or felt is present and is illuminated by said modulated transmitted beam of light;

calibration means for processing said electric signals generated by said light receiver corresponding to said background light level and said illuminated light level by subtracting said electric signal corresponding to said background light level from said electric signal corresponding to said illuminated light level to obtain a calibration signal;

adjusting means for adjusting the intensity of light transmitted by said transmitter so that said calibration signal is normalized; and signal processing means for analyzing said electric signal generated by said light receiver and determining whether the web supported by the wire or felt is present or whether the web is not present and the wire or felt is present.

9. A device according to claim 8 wherein said light transmitter transmits and said light receiver receives from a measurement head in proximity to the material web.

10. A device according to claim 9, wherein said light transmitter comprises an adjustable intensity light output source and a fiber optic cable and wherein said light receiver comprises a light detector and a fiber optic cable.

11. A device according to claim 9, wherein said light transmitter is a transmitter for generating visible light having a frequency above a spectrum associated with fluorescent light.

12. A device according to claim 9, wherein said measurement head comprises a protective casing and a cable communicating with said control means and said signal processing means, said measurement head further comprises an electronic circuit and said cable comprises an electronic cable for communicating electrical signals with said control means and said signal processing means.

13. A device according to claim 9, wherein said measurement head comprises a protective casing, a first fiber optic cable transmitting light from said transmitter, a transmit optic for transmitting said transmitted light from said first fiber optic cable to the material web, a receive optic for receiving said reflected light from the material web, a second fiber optic cable receiving light from said receive optic and transmitting it to said light receiver.

14. A device according to claim 9, further comprising a compressed air supply capable of supplying a compressed air stream, wherein said measurement head comprises a protective casing with at least one opening through which light is transmitted, and wherein the compressed air stream from said compressed air supply is applied to said at least one opening to prevent foreign particles from collecting therein.

15. A device according to claim 8, wherein said signal processing means further comprises a high pass filter for passing rapid changes in the electric signal, a transmitted light pulse generating circuit for controlling said pulse of light from said light transmitter, and a sampling control circuit for controlling sampling of said signal at a time when said light transmitter transmits a pulse of light.

16. The device according to claim 8, wherein said control means normalizes said calibration signal at preset intervals.

* * * * *